United States Patent [19]

Maloney

[11] Patent Number: 4,869,004

[45] Date of Patent: Sep. 26, 1989

[54] BADGE HOLDER

[76] Inventor: John E. Maloney, 396 Thelma Ct., Wheeling, Ill. 60090

[21] Appl. No.: 119,135

[22] Filed: Nov. 10, 1987

[51] Int. Cl.[4] ..... A44C 3/00

[52] U.S. Cl. ..... 40/1.5; 40/662

[58] Field of Search ..... 40/1.5, 20, 630, 661, 40/664, 642

[56] References Cited

U.S. PATENT DOCUMENTS

| | | | |
|---|---|---|---|
| 2,341,467 | 2/1944 | Nedell | 40/1.5 |
| 3,257,747 | 6/1966 | Schimmel | 40/1.5 |
| 3,953,910 | 5/1976 | Farb | 40/1.5 |
| 4,000,570 | 1/1977 | Carmen | 40/1.5 |

FOREIGN PATENT DOCUMENTS

| | | | |
|---|---|---|---|
| 2078666 | 1/1982 | United Kingdom | 40/1.5 |

*Primary Examiner*—Gene Mancene
*Assistant Examiner*—Wenceslao J. Contreras
*Attorney, Agent, or Firm*—John J. Kowalik

[57] ABSTRACT

An identification badge holder which is readily adapted to assembly line production thereby requiring less labor while resulting in a durable, pleasing and less costly product. An anaerobic adhesive is utilized to assist in the assembly process while also providing mechanical and adhesive properties to add strength and durability. A method for the manufacture of the identification badge holder is also disclosed.

18 Claims, 1 Drawing Sheet

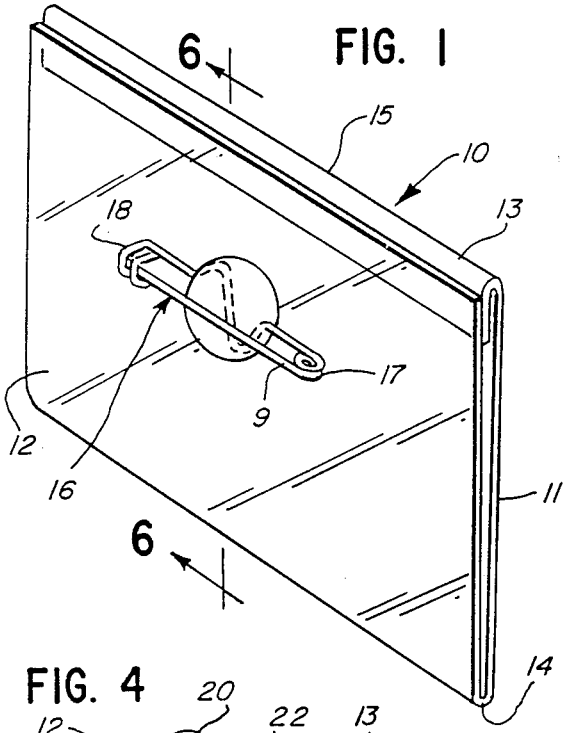
FIG. 1
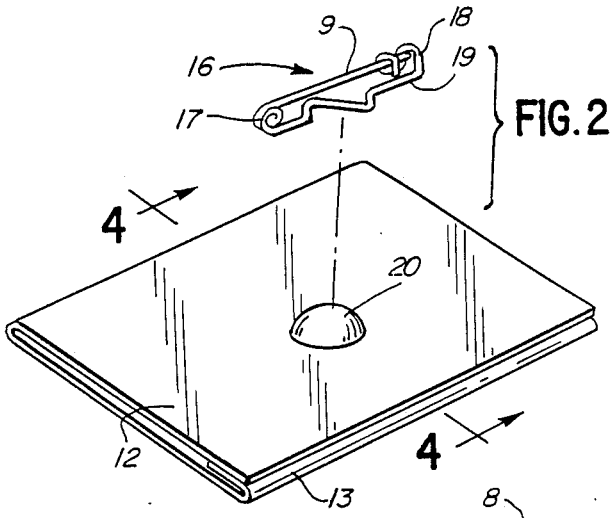
FIG. 2
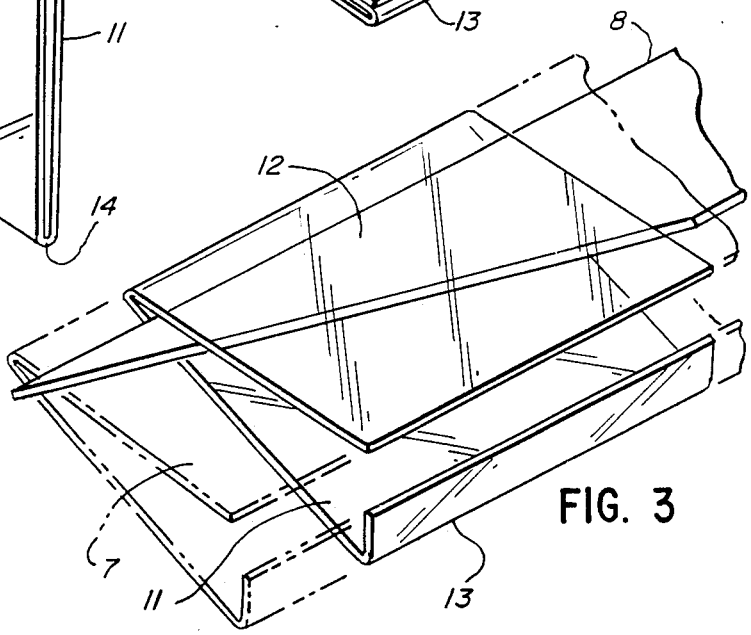
FIG. 3
FIG. 4
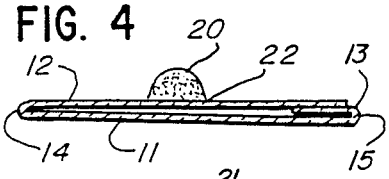
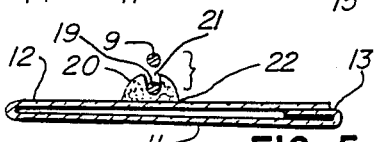
FIG. 5
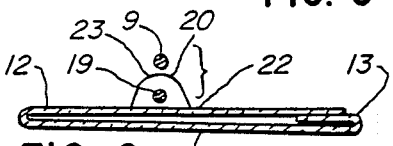
FIG. 6
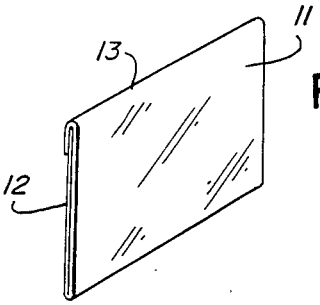
FIG. 7
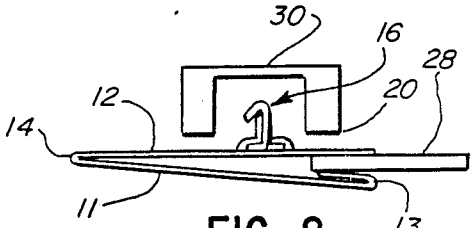
FIG. 8
FIG. 9
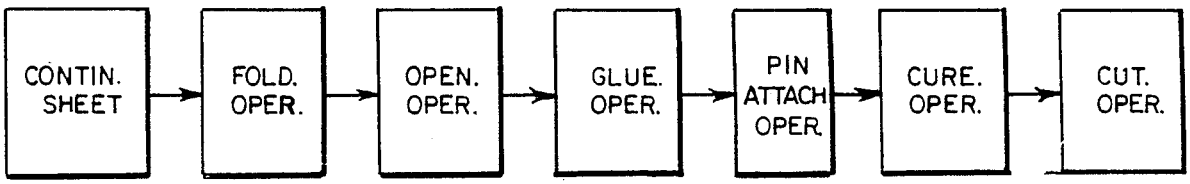

BADGE HOLDER

BACKGROUND OF THE INVENTION

1. Field Of The Invention

The invention relates to clear/folded plastic identification badge holders, having pins or clips for affixing the badge holder to the apparel of the wearer.

2. Description of the Prior art

The prior art in the pin or clip style identification badge field can be viewed as falling into three major categories. These categories depend on the method by which the pin or clip is attached to the badge itself, or a transparent holder for paper or cardboard identification.

By far the most common identification badge style is that in which a single folded sheet of transparent plastic, comprising a rear portion, a face portion and a folded locking portion, has two holes punched in the rear portion. Because of the flexible nature of the plastic used, the face portion can be flexed and released from the space formed by the U-shaped section where the rear portion folds over into the locking tab. This, thereby, permits access to the rear from the interior of the badge. In this embodiment a pin comprising a base element, upstanding legs, perpendicular thereto, with one leg forming a hook, and the other leg forming a coil spring element and then extending into the pin itself, is inserted manually. This method has been quite economically successful because it is relatively economical in terms of the material involved. This method is very labor intensive and is customarily accomplished through the shipment of the folded plastic elements and pin elements separately, to persons who assemble them on a piece work compensation basis.

The second category of the prior art involves badge and fastener elements, which are interconnected through the use of some independent third structure affixed to the badge. An example of this is Pat. No. 4,020,575 in which a second sheet of plastic is ultrasonically welded to the backing portion of the badge holder itself, the separate sheet comprising the structure which retains the pin. Pat. No. 2,213,449 uses a metal plate, spot welded to the badge holder. Pat. No. 2,594,623 shows a box shaped structure to hold the pin element which is either integrally molded with the badge, or is cemented thereto.

The third grouping of prior art can be seen to relate to structures, or methods, in which the pin element is affixed directly to the reverse of the badge, or badge holder, without additional third structures. Pat. No. 3,466,773 relates to a molded plastic badge having parallel ridges, molded from the same material the badge is formed from, which ridges are deformed under heat and pressure, melting them together surrounding the pin element. Pat. Nos. 3,257,747 and 3,953,910 involve processes closely similar to those of prior art Pat. No. 3,466,773 referred to above whereby the pin element itself is embedded in the back of the badge itself, the molten plastic of the badge flowing through openings in the pin element, and then setting, holding the pin element in place.

The invention uses a completely different approach whereby three elements are used, a badge holder body, a fastener or pin and an adhesive bead having both adhesive and mechanical properties.

DISCLOSURE OF INVENTION

The invention was created to provide an alternative to the labor intensive, yet dominant style of badge holder whereby purchasers can insert preprinted, paper or cardboard badges into an entirely transparent plastic sheet holder. This configuration is commonly used at conventions and meetings.

Given the environment in which the product is likely to be used, specifically where last minute additions or changes are required, the badge holders are permanently provided to the attendees of the functions, and hence, with respect to the sponsor or promoter of the event, are essentially disposable and, therefore, badges of a permanent nature are neither required, nor suitable.

These applications require a product adapted to mechanized assembly line production, yet which result in economical material requirements, and a product both durable and pleasing in appearance.

In keeping with this general background, an object of the invention is to produce a product taking advantage of both mechanical and adhesive properties of an adhesive bead.

Another object of the invention is to have a pin, or other attachment member, firmly affixed to the reverse of a badge holder, so as to avoid disattachment in normal service.

Another object of the invention is to place the adhesive bead in the appropriate assembly line sequence and take advantage of its bridging properties.

Another object of the invention is to utilize the bead of the uncured adhesive of the unfinished product as a vehicle to hold the attachment pin in position for subsequent curing and assembly.

Another object in addition to the use of the uncured bead for transportation of the pin is to use said uncured bead to maintain the attachment pin in appropriate orientation.

Another object of the invention is to permit the use of a standardized series of steps to enable the use of adjustments to change the configuration of the badge holder in such areas, such as attachment pin positioning relative to the axial center line so that an effective change in the orientation of the pin relative to the attachment tab can be accomplished thereby customizing "top opening" or "bottom opening" badge holders.

Another object of the invention is to permit the automatic placement of pins, or attachment devices, in an assembly line sequence.

Another object of the invention is to cure the adhesive bead in the appropriate assembly line sequence.

Another object of the invention is to maintain the flat face surface of the badge holder free from optical distortion due to the exothermic curing properties of the adhesive bead.

Another object of the invention is to facilitate the pin attachment device affixation in such a manner as to permit operation in an assembly line beginning with rolls of plastic sheet and resulting in the finished product.

Another object of the invention is to permit adjustment for dimensions of badge holders from small business card sizes to large convention admission and security badge sizes, with minimal need for stocking of specific sizes.

Another object of the invention is that the fixed placement of the attachment pin provides advantages in the use of the badge holder in that it is easier to don and doff, and while worn moves to a lesser degree than certain prior art configurations.

Other objects and advantages of the invention, will be apparent, or will be referred to hereafter.

BRIEF DESCRIPTION OF THE DRAWINGS

FIG. 1 is a perspective view of the finished product viewing from the reverse.

FIG. 2 is a perspective view of the product prior to attachment of the clothing attachment pin.

FIG. 3 is a perspective view of the product during the opening operation.

FIG. 4 is a sectional view of the product along line 4—4 as shown in FIG. 2.

FIG. 5 is a sectional view of the product along lines similar to 4—4 as shown in FIG. 2, but showing initial pin placement.

FIG. 6 is a sectional view of the product along line 6—6 as shown in FIG. 1.

FIG. 7 is a perspective view of a product from the face.

FIG. 8 is a side view of the product immediately prior to the curing operation.

FIG. 9 is a block diagram detailing the method of operation.

DESCRIPTION OF THE PREFERRED EMBODIMENT

FIG. 1 shows a finished badge holder (10), as shipped to the end user, which is formed from a sheet of transparent semi-rigid plastic, providing relatively distortion-free optical characteristics to permit the reading of a badge inserted in the badge holder. In the preferred embodiment, polyvinyl chloride plastic is used from a ribbon and cut and formed in a single folded sheet. It is not intended, however, to limit the invention to only badge holders formed by a single blank sheet or to any particular type or specification of plastic.

Referring again to FIG. 1 the badge holder (10) is shown having a front face or element (11), a back face or element (12), and a retainer tab or flange (13), which holds the back element or flange (12), against the front element or panel (11) when in use. These elements further contribute to retain a badge or identification card placed in the space between the front element or panel (11) and back element or panel (12). In the preferred embodiment, badge holder (10) is formed from a single sheet or ribbon. The sheet is folded at the merger (14) between the front (11) and back (12) elements or panels, and the front tab or flange merger point (15) between the front element or panel (11) and retainer tab or flange (13). In alternative embodiments, operations such as ultra-sonic welding or other bonding of separate sheets to comprise the components of front, back and retainer tab or flange, are technically feasible.

In another alternative embodiment, a continuous sheet or ribbon may be folded so as to form the elements in an "open" position as described hereinafter, thereby accomplishing the same result as use of the opening blade (8).

The back element or panel (12) of the badge holder (10) is fitted with an attachment pin (16), analogous to a safety pin having a spring (17) and a pin lock (18). The attachment pin (16) is affixed to the back element or panel (12) with a bead of curable adhesive (20).

In the preferred embodiment, the attachment pin is placed slightly above the center of gravity of the folded or formed badge holder (10), thereby providing increased stability in use whereby the badge holder would tend to "hang" slightly from the pin, and further providing orientation so that all badge holders in a batch would "open" at the "top" in a uniform manner. In the preferred embodiment, as shown in FIG. 1, the badge holder opens at the "top" relative to the pin orientation. It is equally feasible, and the assembly line procedure enables more flexibility in consistent placement of the pin so that in an alternative embodiment, such as with the retainer tab or flange on the bottom, production of badges to order can be accomplished through adjustment of the adhesive and attachment pin placement elements.

FIG. 2 shows the attachment pin (16) in relation to the adhesive bead (20) and back element or panel (12) prior to placement of the pin (16) in the bead at a point where the bead (20) is uncured. The pin (16) includes a base (19), the spring (17) and lock (18) which are perpendicular to the base (19) and a straight pin member (9) attached to the spring (17). The spring (17) provides a bias for pin member (9) away from lock (18) to provide a sure connection with the lock (18) when in use. This configuration of pin is used in a preferred embodiment, but other forms of attachment device may be suitable in lieu thereof, such as "D" shaped rings onto which spring clips, rather than pins may be attached, as well as alligator clips, so long as the attachment element is capable of automatic manipulation and placement.

It is also possible to use alternative embodiments of badge holder stock, other than the continuous stock, including sheet or ribbon, which is utilized in the preferred embodiment, so long as appropriate methods for moving said stock down an assembly line are provided and the individual badge holder elements are maintained in proper orientation and registry. The use of continuous stock, including sheet or ribbon, provides these latter functions until the point that each individual badge holder element is separated from the continuous stock. The use of continuous stock allows the stock, including sheet or ribbon, to be pulled through the various operations.

FIG. 3 shows a portion of the continuous badge holder stock (7). The stock (7) has just gone through certain steps in order to be folded, resulting in the retainer tab (13) overlapping the back element (12). An opener blade (8) is inserted between the front element or panel (11) and back element or panel (12) to move the back element or panel (12) from a closed position, where it is retained by retainer tab or flange (13), to an open position, where back element or panel (12) is not retained by retainer tab or flange (13). This step is performed due to the necessity of the stock (7) to be maintained in separate relation in later steps of the process.

FIG. 4 is a sectional view of the product, viewed in a direction along lines 4—4 of FIG. 2. This view shows the folded plastic sheet or ribbon in the horizontal orientation used at this stage of the fabrication process. In this orientation, the front element or panel (11), is oriented downward and the back element or panel (12) oriented upward. Also, apparent is the retainer tab or flange (13). The adhesive bead (20) is shown in section which forms an adhesive bond (22) with the back element or panel (12). It is essential for the bond to be strong enough to withstand both the normal manufacturing and packaging operations, and flexing of the back element (12) and front element (11) for insertion of the badge or identification card, and closure of the badge holder. In addition, while designed to be economical to produce, and have a limited service life of, for example, the several days of a trade show, the product in use is affixed to the clothing of the wearer, which may be subject to, among other things, repeated attachment and detachment from the clothing, the donning and doffing of outer wear and other activities hazardous to the integrity of the badge holder product. Further, the adhesive must be chemically compatible with the plastic used in the badge holder. As will be pointed out, other properties are essential.

As discussed in connection with the illustration in FIG. 7, the adhesive bond formed between the adhesive bead and the badge holder panel and the mechanical strength of the adhesive bead itself is a result of an exothermic chemical reaction. The heat given off by the curing of the adhesive may be expected to physically modify the surface of the sheet or ribbon as the sheet or ribbon is sensitive to heat, in addition to forming an adhesive bound to the surface. Thus, one important point in development of the process was designing a method for controlling the adverse effects of this exothermic reaction on the sheet or ribbon which forms the body of the badge holder, as illustrated in FIG. 7.

FIG. 5 shows the product in the next stage of fabrication. The attachment pin base (19) of pin (16) has been placed in the adhesive bead (20). Evident in FIG. 5 is the gap (21) formed by the placement of the base (19) in the adhesive bead (20). It is essential that the adhesive have sufficient cohesion to form a bead and remain somewhat raised above the surface, higher than the thickness of the pin base (19). Because of the viscosity, however, for a time, a gap (21) will be formed. If the gap (21) remains, however, it has been discovered that the attachment will have insufficient strength to stand up to the wear and tear it is subjected to in use.

In the preferred embodiment, a brass plated, steel attachment pin is utilized. This provides for the greater adhesion between the adhesive and the attachment pin itself. In other embodiments, however, by virtue of the bridging of the adhesive bead (20) whereby the adhesive bead (20) flows, closing the gap shown in FIG. 5, which bisects the generally hemispherical adhesive bead (20), a strong bond is formed. The gap (21) is closed by this flow so that as is shown in subsequent illustrations, the flow of the adhesive completely surrounds the base element (19) of the pin (16) forming a bridge across the pre-existing gap (21), resulting in both an adhesive bond and a mechanical fixation of the attachment pin base.

FIG. 6 shows the third step in the attachment pin (16) affixation, and represents the placement of the attachment pin (16) in final position at the point where the adhesive may be (20) cured. Apparent in this view, is the bead (20) affixed to the back element (12), which because of the viscous flow properties of the adhesive has formed a bridge (23) closing the gap (21) shown in the preceding figure and, thus the adhesive completely surrounds the attachment pin base (19). At this point the adhesive may be cured.

FIG. 7 illustrates the front element (11) of a closed badge holder (10) where a synthetic adhesive has been permitted to cure, while the back element (12) is in contact with the front element (11) of the surface. Because of the fact that modern synthetic adhesives, including anaerobic adhesives, produce an exothermic reaction during curing, the heat given off during this reaction has resulted in a dimple, or ripple in the surface. The presence of such a dimple or ripple, is unacceptable because the reason for use of relatively non-distorting transparent plastic is to provide a pleasing, undistorting viewing of the inserted badge, and the text imprinted thereon. Accordingly, in fabrication, steps must be taken to avoid this phenomenon.

To overcome the dimple or ripple effect described above and shown in FIG. 7 the back element (12) and front element (11) are separated after pin placement, prior to curing, and are maintained separate during the curing operation. As seen in FIG. 8 the elements are maintained separate by separation rail (28) that permits separation of back element (12) and front element (11) during the curing of the adhesive, thereby protecting against the impermissible heat transfer from the adhesive bead (20) to the front element (11). As further shown in FIG. 8, a pin guide (30) helps protect the pin in the uncured adhesive bead (20) from disorientation prior to the curing operation.

Thus, in the preferred embodiment a series of steps described herein and shown as a block diagram in FIG. 9, is performed as follows: a continuous sheet or ribbon stock is fed from a roll of polyvinyl chloride plastic which is formed or folded to create back and front elements and is folded again to yield a retainer tab portion. The back and front elements are moved to an open position through the use of an opener blade. The continuous sheet or ribbon stock is fed at a controlled speed, maintaining its transverse positioning and registry to a gluing station and, in the preferred embodiment, first passes under a static electricity dissipater comprising a conductive element such as a wire screen maintained in close proximity to the rear surface of the continuous, folded badge holder stock, which may be sheet or ribbon. A glue dispenser in the preferred embodiment applies viscous adhesive under relatively constant pressure through reciprocating motion timed in accordance with the speed of the movement of the badge holder stock and length of the ultimately desired product. The adhesive is applied so as to permit placement of an adhesive bead at a point in the assembly line in close proximity to the mechanism by which the attachment pins are placed yet permitting sufficient clearance between the independent mechanisms.

Pin placement in the preferred embodiment can be accomplished by the orientation of pins through the use of a vibratory feeder and track which places the pins in the appropriate orientation of application but maintained slightly above the level of the top of the bead by air pressure holding it against a guide until the timing of the mechanism operates a plunger or pin which places the pin in the bead as earlier depicted in FIG. 5.

An opening blade (8) previously having opened the identification badge holder (10) facilitates the separation of the front and back members by the separation rail (28) throughout the curing stages. Therefore, as the assembly moves down the assembly line it enters the pre-curing tunnel at which point the pin guide (30) helps protect the pin in the uncured adhesive from disorientation due to either vibrations or air currents. Then the assembly enters the curing tunnel and subsequently the post-curing tunnel. In the preferred embodiment the curing tunnel uses ultraviolet light. The curing tunnel further includes compressed air inlet and exhaust manifolds; however, this feature for cooling is non-essential in operation given adequate temperature control. Separation between back element or panel 12 and front element or panel 11 of the badge holder is provided to control distortion of the sheet or ribbon stock from the exothermic curing reaction on the transparent face of the badge and to avoid deterioration in the structural integrity of the back element of the badge holder upon which the attachment pin is affixed.

Throughout the curing stage from the point at which the separation rail (28) maintains the separation, the front element and back element of the badge holder have been maintained separate through the use of the continuous separation rail. Separation is maintained following exit of the curing tunnel as the assembly passes, in the preferred embodiment, through a cooling tunnel with one end sealed against the curing tunnel and in which the flow of pressurized air continues.

Power for the movement of the continuous badge holder stock, which may be sheet or ribbon, can be supplied by friction from rollers held in tension against the surface of the badge holder sheet or ribbon stock. In the preferred embodiment however, other power methods may be used to supplement these rollers or replace them. Following passage through the rollers, the stock, which may be sheet or ribbon, with attached pins passes through a cutter with adjustable registration which cuts the continuous folded sheet or ribbon stock into individual badge holders. Upon exiting the cutter, the badge holder passes over an inclined platen with a series of apertures through which compressed air passes thereby providing a reduction in friction in order to continue the motion of the cut badge holders, although they are no longer to be driven by the aforementioned, until entry on a conveyer belt so as to avoid tangling or other interference between badge holders and pins.

In an alternative embodiment to the process described above, a pre-adhesive may be applied to the rear of the back element. This would allow the pin to be held in place on the back element during the gluing and curing steps and prevent dislodgment during these operations.

Thus it is apparent that there has been provided, in accordance with the invention, a new and improved identification badge holder and method of manufacture. While the inventions have been described in conjunction with specific embodiments thereof, it is evident that many alternatives, modifications and variations will be apparent to those skilled in the art in light of the foregoing description. Accordingly, it is intended to include all such alternatives, modifications, and variations as set forth within the spirit and broad scope of the appended claims.

In accordance with my invention I claim:

1. A method of manufacturing an identification badge holder comprising the steps of:

providing stock for forming said identification badge holder;

folding said stock to create front and rear panels interconnected along a common edge;

folding said stock to create a retainer tab flange, with the retainer flange at one edge of said front panel;

inserting opening means between said front and rear panels to separate same to enable subsequent thermal isolation between the front and rear panels;

applying adhesive to the back of said rear panel;

placing user attachment means on the back of said rear panel and into said adhesive without piercing said rear panel; and thermally isolating the rear panel from the front panel after inserting the opening means and before the curing step and entering said stock into a curing tunnel and curing said adhesive by ultra-violet rays.

2. The method as defined in claim 1 and forming said adhesive in at least one bead.

3. The method as defined in claim 2 and feeding said stock as a continuous ribbon.

4. The method as defined in claim 3 and cutting the continuous ribbon into discrete length after said adhesive is cured.

5. The method as defined in claim 4 and moving said continuous ribbon at controlled speed.

6. The method as defined in claim 5 and passing said continuous ribbon under a static electricity dissipater prior to the application of said adhesive.

7. The method as defined in claim 6 and passing said user attachment means through guide means prior to curing of said adhesive.

8. The method as defined in claim 7 and supplying pressurized air about the continuous ribbon during the curing stage.

9. The method as defined in claim 8 and passing said continuous ribbon through a cooling tunnel after exiting the curing tunnel.

10. The method as defined in claim 9 and placing user attachment means slightly above the center of gravity of said identification badge holder on said rear panel.

11. The method as defined in claim 10 and applying said adhesive to said rear panel to form a bead that is somewhat raised above the surface of said rear panel.

12. The method as defined in claim 11 and controlling the flow of said adhesive so that it encompasses the base of said user attachment means after curing.

13. The method as defined in claim 12 and using an ultra-violet curable anaerobic adhesive.

14. The method as defined in claim 13 wherein said continuous ribbon is poly vinyl chloride plastic.

15. A method of manufacturing identification badge holders comprising the steps of:

providing stock for forming said identification badge holder;

folding said stock to create a front element, a rear element and an intervening retainer tab portion maintaining said front and rear elements in separate relation;

applying adhesive to the back of said rear element;

positioning a badge attachment in the adhesive to form an assembly; and curing said adhesive while maintaining the front and rear elements in separate relation;

wherein separation of said front and rear elements is maintained by placing supplemental separation means during the curing of said adhesive;

and forming said adhesive into at least one bead of a depth sufficient to encompass said badge attachment; and entering said assembly into a curing tunnel and curing said adhesive by ultraviolet rays.

16. An identification badge holder comprising;

a front element and a rear element connected at a merger point;

retainer tab means formed on the opposite edge of said front element;

adhesive means on said rear element;

a badge attachment attached to the rear element by the adhesive means; and said adhesive means and said badge attachment located slightly above the center of gravity of said identification badge holder thereby providing increased stability in use;

said adhesive means providing the sole attachment between said badge holder and badge attachment;

said adhesive being of a class of adhesives reacting exothermically upon curing; and said adhesive compatible to form an adhesive bond to said plastic, and form an adhesive and mechanical bond to said badge attachment.

17. The identification badge holder of claim 16 wherein said front and rear elements are in parallel planes spaced from one another;

said retainer tab means generally parallel to said front and rear elements; and said rear elements having an edge interlocking said front element and said retainer tab means.

18. The identification badge holder of claim 17 wherein said adhesive means is an ultra-violet sensitive anaerobic adhesive.

* * * * *